US007917071B2

(12) United States Patent
Hirai et al.

(10) Patent No.: US 7,917,071 B2
(45) Date of Patent: Mar. 29, 2011

(54) TRANSFER BELT UNIT AND IMAGE FORMING APPARATUS USING THE SAME

(75) Inventors: Masashi Hirai, Katano (JP); Mikio Kakui, Ikoma-gun (JP); Yoshiaki Masuda, Nara (JP); Susumu Murakami, Kizugawa (JP); Kuniaki Nakano, Kizugawa (JP); Kazuaki Ishikawa, Hamburg (DE); Tomomi Tanaka, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 319 days.

(21) Appl. No.: 12/252,968

(22) Filed: Oct. 16, 2008

(65) Prior Publication Data

US 2009/0097888 A1 Apr. 16, 2009

(30) Foreign Application Priority Data

Oct. 16, 2007 (JP) ..... 2007-269234

(51) Int. Cl.
*G03G 15/08* (2006.01)
*G03G 15/01* (2006.01)
*G03G 15/20* (2006.01)

(52) U.S. Cl. ..... 399/308; 399/121; 399/299; 399/302

(58) Field of Classification Search ..... 399/121, 399/299, 302, 308
See application file for complete search history.

(56) References Cited

U.S. PATENT DOCUMENTS

| | | | | |
|---|---|---|---|---|
| 5,307,127 | A | 4/1994 | Kobayashi et al. | |
| 6,519,426 | B2 | 2/2003 | Goto et al. | |
| 6,659,898 | B2 | 12/2003 | Morikoshi et al. | |
| 6,778,802 | B2 | 8/2004 | Kabata et al. | |
| 6,850,726 | B1 * | 2/2005 | Mizuno et al. | 399/299 |
| 7,254,359 | B2 | 8/2007 | Iwakura et al. | |
| 7,460,802 | B2 | 12/2008 | Nakamura et al. | |
| 2002/0003970 | A1 | 1/2002 | Goto et al. | |
| 2003/0219296 | A1 | 11/2003 | Kabata et al. | |
| 2005/0141930 | A1 * | 6/2005 | Murakami et al. | 399/302 |
| 2005/0185991 | A1 | 8/2005 | Iwakura et al. | |
| 2006/0257176 | A1 | 11/2006 | Kawasaki et al. | |
| 2007/0147862 | A1 | 6/2007 | Nakamura et al. | |
| 2007/0269241 | A1 | 11/2007 | Sawai et al. | |
| 2009/0047592 | A1 * | 2/2009 | Okamoto et al. | 430/109.3 |

FOREIGN PATENT DOCUMENTS

| | | | |
|---|---|---|---|
| JP | 5-241439 | A | 9/1993 |
| JP | 11-119463 | A | 4/1999 |
| JP | 2001-282011 | A | 10/2001 |
| JP | 2001-324892 | A | 11/2001 |

(Continued)

*Primary Examiner* — David M Gray
*Assistant Examiner* — Joseph S Wong
(74) *Attorney, Agent, or Firm* — Nixon & Vanderhye, PC

(57) ABSTRACT

An image forming apparatus includes a transfer belt unit which has an intermediate transfer belt for supporting toner images and primary transfer rollers for pressing the intermediate transfer belt against corresponding photoreceptor drums and moves the intermediate transfer belt along the surface of each photoreceptor drum to transfer the toner images to the intermediate transfer belt. The intermediate transfer belt is formed so as to be 30 μm to 50 μm in average thickness, each primary transfer roller is arranged at a position, along the moving direction of the intermediate transfer belt, which is deviated downstream with respect to the moving direction from the position where the intermediate transfer belt is in contact with the photoreceptor and which is projected toward the photoreceptor drum side so as to press the intermediate transfer belt against photoreceptor with a nip pressure ranging from 10 gf/cm$^2$ to 40 gf/cm$^2$.

9 Claims, 7 Drawing Sheets

FOREIGN PATENT DOCUMENTS

| | | | |
|---|---|---|---|
| JP | 2002-14515 | A | 1/2002 |
| JP | 2003-255718 | A | 9/2003 |
| JP | 2003-302842 | A | 10/2003 |
| JP | 2005-234229 | A | 9/2005 |
| JP | 2006-178232 | A | 7/2006 |
| JP | 2006-308758 | A | 11/2006 |
| JP | 2007-171602 | A | 7/2007 |
| JP | 2007-310024 | A | 11/2007 |

* cited by examiner (Principle of fluidity measurement)

FIG.9

(Void ratio)

| Belt | | 95 μm | 80 μm | 60 μm | 50 μm |
|---|---|---|---|---|---|
| Paper type | MI | 15.13 | 0.81 | 3.39 | 0.56 |
| | IGEPA | 20.94 | 7.63 | 5.49 | 0.81 |

TRANSFER BELT UNIT AND IMAGE FORMING APPARATUS USING THE SAME

This Nonprovisional application claims priority under 35 U.S.C. §119(a) on Patent Application No. 2007-269234 filed in Japan on 16 Oct. 2007, the entire contents of which are hereby incorporated by reference.

BACKGROUND OF THE INVENTION (1) Field of the Invention

The present invention relates to a transfer belt unit that uses a belt-like intermediate transfer medium to perform transfer of the toner image formed on the photoreceptor drum surface by an electrophotographic image forming process as well as relating to an image forming apparatus using the transfer belt unit.

(2) Description of the Prior Art

Conventionally, in the field of image forming apparatus for performing an electrophotographic image forming process, there have been known image forming apparatus which adopt a so-called intermediate transfer system in which the toner image formed on the surface of the photoreceptor (photoreceptor drum) is primarily transferred to an intermediate transfer medium (e.g., intermediate transfer belt) and the toner image is then secondarily transferred from the intermediate transfer medium to a recording medium such as recording paper etc.

In such an image forming apparatus using an intermediate transfer system, in order to achieve high image quality it is demanded that the toner image carried on the photoreceptor is transferred to recording paper exactly through the primary and secondary transfer stages.

However, when thick recording paper etc. having raggedness is used as the recording medium, there have been the problems of transfer failures occurring such as void printed characters, degradation of graininess (density irregularity occurring in high spatial frequency) in a so-called solid image area having totally high density and degradation of mottle (density irregularity occurring in low spatial frequency).

Character void defect and the like is considered to be the result of the transfer electric field acting strongly on the potential gap between the so-called white electric field around a fine line and the electric field at the fine line and to be the result of the intermediate transfer belt being unable to be uniformly charged due to unevenness on its outer peripheral surface.

To deal with this defect, there has been a prior art disclosure in which character void defect is prevented by preparing a toner adjusted as to the mean particle size and the degree of cohesion, for example (patent document 1: Japanese Patent Application Laid-open Hei 11-119463).

There is also a disclosure of a conductive belt as an intermediate transfer belt, which is composed of at least, three layers, a base layer, an elastic layer and a surface layer being laminated in this order from the inner peripheral surface toward the outer peripheral surface (see Japanese Patent Application Laid-open 2006-178232). The base layer is specified to be 50 to 150 μm thick, having a tensile modulus of elasticity of 2,000 MPa or greater with its surface electric resistivity on the inner peripheral side thereof set at $10^6\Omega/\square$ to $10^{11}\Omega/\square$. The elastic layer is specified to be 400 to 1500 μm thick, having a JISA hardness of 60 or below and a volume resistivity of $10^6\Omega\cdot$cm to $10^8\Omega\cdot$cm. The surface layer is specified to be 3 to 30 μm thick, having a composite modulus of elasticity of 250 MPa or below.

Further, as another intermediate transfer belt an endless belt is disclosed which is specified such that the flexibility in the circumferential direction of the belt, based on JIS P-8115 exceeds 5000 counts, the tensile modulus of elasticity in the circumferential direction of the belt is 1500 to 5000 MPa, the elongation at break in both the circumferential direction and the width direction of the belt is 30% or greater, the average thickness of the belt is 70 to 300 μm, the surface electric resistivity is $1\times10^1$ to $1\times10^{16}\Omega$ or the volume electric resistivity is $1\times10^1$ to $1\times10^{16}\Omega\cdot$cm, and the maximum value of the aforementioned resistivity in one singular endless belt falls equal to or lower than 100 times the minimum (see patent document 3: Japanese Patent Application Laid-open 2001-282011).

Meanwhile, the fixing temperature in recent image forming apparatus tends to be lowered aiming at power-saving measures, hence as one answer to this the melting point of the toner has become lowered. As a result, however, there occurs the problem that the toner itself is prone to cohere due to slight pressure or heat.

That is, when a toner that is high in cohesiveness is used with a conventional intermediate transfer belt having a thickness of 70 μm or greater, which has been usually used, toner cohesion is prone to occur at the primary transfer because the pressing force is too high. As a result, the performance of the secondary transfer degrades.

In order to prevent this phenomenon, there is known a so-called offset arrangement in which the primary transfer roller is arranged on the downstream side of the photoreceptor so that the photoreceptor and the primary transfer roller will not come in direct contact with each other. However, in this case, if the toner is poor in fluidity (high in cohesiveness), there occurs a new problem that the secondary transfer performance lowers to thereby cause degradation of final image quality.

SUMMARY OF THE INVENTION

A transfer belt unit according to the first aspect of the present invention includes: a belt-like intermediate transfer medium for temporarily supporting a toner image that was formed on the surface of a photoreceptor; and a transfer roller for pressing the intermediate transfer medium against the photoreceptor, and is characterized in that the intermediate transfer medium has the toner image transferred from the photoreceptor surface whilst moving along the surface of the photoreceptor, the intermediate transfer medium is formed to be no less than 30 μm and no more than 50 μm in average thickness, and, the transfer roller is arranged, along the moving direction of the intermediate transfer medium, downstream with respect to the moving direction from the point where the intermediate transfer medium is in contact with the photoreceptor and which is arranged closer to the photoreceptor side, from the position on the tangent line passing the contact point where the intermediate transfer medium comes into contact first in the moving direction with the outer peripheral surface of the photoreceptor, so as to press the intermediate transfer medium against photoreceptor with a nip pressure ranging from no less than $9.8\times10^{-2}$ MPa (10 gf/cm$^2$) and no more than $39.2\times10^{-2}$ MPa 40 (gf/cm$^2$).

A transfer belt unit according to the second aspect of the present invention is characterized in that in addition to the configuration of the above first aspect, the intermediate transfer medium is configured so as to be able to have toner images formed by a plurality of photoreceptors that are arranged in turn in the moving direction of the intermediate transfer medium, a plurality of transfer rollers are arranged at positions corresponding to the plural photoreceptors, and the plural transfer rollers are arranged so that the transfer roller corresponding to the photoreceptor located on the more downstream side with respect to the moving direction of the intermediate transfer medium is arranged less close to the photoreceptor side from the position on the tangent line passing the contact point where the intermediate transfer medium comes into contact first in the moving direction with the outer peripheral surface of the photoreceptor.

A transfer belt unit according to the third aspect of the present invention is characterized in that in addition to the configuration of the above first or second aspect, the distance of the transfer roller approaching toward the photoreceptor is no less than 0.5 mm and no more than 0.8 mm.

A transfer belt unit according to the fourth aspect of the present invention is characterized in that in addition to the configuration of any one of the above first to third aspects, the intermediate transfer medium is formed of polyimide-based resin.

A transfer belt unit according to the fifth aspect of the present invention is characterized in that in addition to the configuration of any one of the above first to fourth aspects, the transfer belt unit includes a drive roller that supports and drives the intermediate transfer medium, and the drive roller is 12 mm or greater in diameter.

An image forming apparatus according to the sixth aspect of the present invention is characterized by use of one transfer belt unit selected from those of the first to fifth aspects.

An image forming apparatus according to the seventh aspect of the present invention is characterized in that in addition to the configuration of the above sixth aspect, a toner that has a fluidity of equal to or greater than 2 mg/sec, measured by a vibration technique, or that is poor in fluidity is used.

An image forming apparatus according to the eighth aspect of the present invention is characterized in that in addition to the configuration of the above sixth or seventh aspect, the toner for forming the toner image is specified so that the volume mean particle diameter of the toner is no less than 4 μm and no more than 7 μm.

An image forming apparatus according to the ninth aspect of the present invention is characterized in that in addition to the configuration of any one of the above sixth to eighth aspects, the nip pressure of the intermediate transfer belt on the transfer roller is made smaller as it goes toward the downstream side with respect to the circulating direction of the intermediate transfer belt.

In accordance with the first aspect of the present invention, it is possible to suppress the toner from cohering when the toner image is transferred to the belt-like intermediate transfer medium (at the primary transfer). Accordingly, it is possible to perform fair secondary transfer of the toner image from the belt-like intermediate transfer medium to a recording medium such as recording paper (at the secondary transfer), especially to rough paper having a surface roughness Ra of 2.0 μm or greater.

In accordance with the second aspect of the present invention, the effect of the first aspect can be enhanced since the pressing forces of the intermediate transfer medium are lowered toward the downstream side with respect to the moving direction of the intermediate transfer medium.

In accordance with the third aspect of the present invention, in addition to the above effect of the first or second aspect, it is possible to obtain fair secondary transfer image since the pressing force suitable for transfer can be applied.

In accordance with the fourth aspect of the present invention, in addition to the above effect of the first to third aspects, the mechanical durability of the intermediate transfer medium can improved since the intermediate transfer medium has a high tensile modulus of elasticity and hence unlikely to stretch.

In accordance with the fifth aspect of the present invention, in addition to the above effect of the first to fourth aspects, it is possible to secure a large curvature at the bend of the intermediate transfer medium, hence improve its durability.

In accordance with the sixth aspect of the present invention, it is possible to suppress toner cohesion when the toner image is transferred to the belt-like intermediate transfer medium (at the primary transfer) and hence perform fair transfer of the toner image from the belt-like intermediate transfer medium to recording medium such as recording paper etc. (at the secondary transfer).

Further, it is also possible to cut down the cost for the materials of the intermediate transfer medium etc.

In accordance with the seventh aspect of the present invention, in addition to the above effect of the sixth aspect, it is possible to enhance the above effect on the toner that is prone to cohere at the primary transfer.

In accordance with the eighth aspect of the present invention, in addition to the above effect of the sixth and seventh aspects, it is possible to further enhance the above effect on the toner that is prone to cohere at the primary transfer.

In accordance with the ninth aspect of the present invention, in addition to the above effect of the sixth to eighth aspects, it is possible to further enhance the above effect since increase in the nip pressure acting on the toner as the layers of toner are laminated one over another during the first transfer stage can be suppressed.

DESCRIPTION OF THE PREFERRED EMBODIMENTS

The embodiment of the present invention will hereinafter be described in detail with reference to the accompanying drawings.

Figure 1:
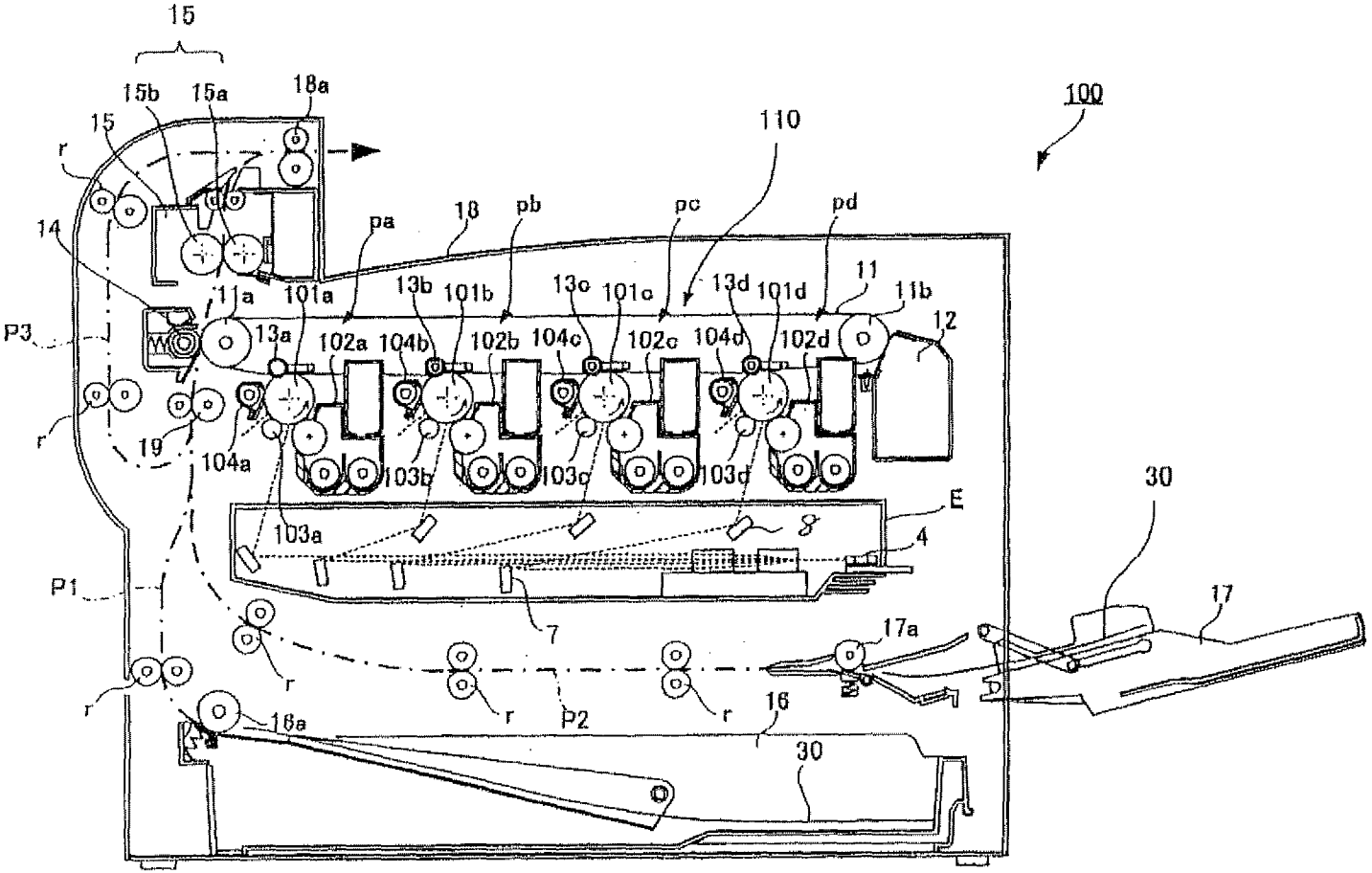
FIG. 1 is an illustrative view showing the configuration of an image forming apparatus according to the embodiment of the present invention.

FIG. 1 is an illustrative view showing the configuration of an image forming apparatus according to the embodiment of the present invention.

As shown in FIG. 1, an image forming apparatus 100 of the present embodiment includes a transfer belt unit 110 comprised of an intermediate transfer belt (intermediate transfer medium) 11 for temporarily supporting the toner images formed on photoreceptor drums (photoreceptors) 101 and primary transfer rollers (transfer rollers) 13 for pressing intermediate transfer belt 11 against photoreceptor drums 101, to transfer the toner images formed on the surfaces of photoreceptor drums 101 by moving intermediate transfer belt 11 along the surface of each photoreceptor drum 101.

To begin with, the whole configuration of image forming apparatus 100 of the present embodiment will be described.

Image forming apparatus 100 forms multi-colored or monochrome images on paper based on the image data of scanned originals or the image data transmitted via a network etc.

This image forming apparatus 100 includes: as shown in FIG. 1, an exposure unit E; photoreceptor drums (photoreceptors) 101 (101*a* to 101*d*); developing units 102 (102*a* to 102*d*) ; charging rollers 103 (103*a* to 103*d*) ; cleaning units 104 (104*a* to 104*d*) ; a transfer belt unit 110 including an intermediate transfer belt 11 and primary transfer rollers 13 (13*a* to 13*d*); a secondary transfer roller 14; a fuser 15; paper feed paths P1, P2 and P3; a paper feed cassette 16; a manual paper feed tray 17; and a paper output tray 18.

Image forming apparatus 100 performs image forming at image forming portions Pa to Pd using image data corresponding to respective four colors, i.e., black (K) and cyan (C), magenta (M) and yellow (Y), the three prime colors of subtractive color mixture that are obtained by color separation of color images.

Image forming portions Pa to Pd have the same configurations. For example, image forming portion Pa is one for black (K) and is composed of photoreceptor drum 101*a*, developing unit 102*a*, charging roller 103*a*, primary transfer roller 13*a* and cleaning unit 104*a* and the like.

These image forming portions Pa to Pd are arranged in a row in the intermediate transfer belt 11's direction of movement (sub scan direction).

Charging roller 103 is a charging device of a contact type which uniformly electrifies the photoreceptor drum 101 surface at a predetermined potential. Here, a contact-type charger using a charging brush or a non-contact type charger using charging wire may also be used instead of charging roller 103.

Exposure unit E in the present embodiment includes an unillustrated semiconductor laser, a polygon mirror 4, a first reflecting mirror 7 and a second reflecting mirror 8, and illuminates photoreceptor drums 101*a* to 101*d* with light beams, i.e., laser beams, that are modulated based on the image data of separate colors, that is, black, cyan, magenta and yellow.

Formed on photoreceptor drums 101*a* to 101*d* are electrostatic latent images based on the image data of respective colors of black, cyan, magenta and yellow.

Developing unit 102 supplies toner to the photoreceptor drum 101 surface with an electrostatic latent image formed thereon to develop the latent image into a toner image. Developing units 102*a* to 102*d* store black, cyan, magenta and yellow color toners, respectively so as to develop the electrostatic latent images for colors formed on photoreceptor drums 101*a* to 101*d* into toner images of black, cyan, magenta and yellow colors.

Cleaning unit 104 removes and collects the toner remaining on the photoreceptor drum 101 surface after development and image transfer.

Intermediate transfer belt 11 arranged over photoreceptor drums 101 is an endless belt that is wound and tensioned between a drive roller 11*a* and a driven roller 11*b*, forming a loop-like moving path. This intermediate transfer belt 11 is formed of a film of about 30 μm to 50 μm thick. Arranged opposing outer peripheral surface of intermediate transfer belt 11, from the upstream side with respect to the transfer belt's direction of movement are photoreceptor drum 101*d*, photoreceptor drum 101*c*, photoreceptor drum 101*b* and photoreceptor drum 101*a* in the order mentioned.

Primary transfer rollers 13*a* to 13*d* are arranged at positions opposing respective photoreceptor drums 101*a* to 101*d* with this intermediate transfer belt 11 sandwiched therebetween. The areas where intermediate transfer belt 11 opposes photoreceptor drums 101*a* to 101*d* form respective primary transfer stations.

In order to transfer the toner images carried on the surfaces of photoreceptor drums 101*a* to 101*d* to intermediate transfer belt 11, each of primary transfer rollers 13*a* to 13*d* is applied by constant-voltage control with a primary transfer bias that has the opposite polarity to that of the charge on the toner. With this arrangement, the toner images of individual colors formed on photoreceptor drums 101 (101*a* to 101*d*) are successively transferred to the outer peripheral surface of intermediate transfer belt 11 so that a full-color toner image is formed on the outer peripheral surface of intermediate transfer belt 11.

If image data involving only part of colors of yellow, magenta, cyan and black is input, among the four photoreceptor drums 101*a* to 101*d* electrostatic latent images and hence toner images are formed only for the photoreceptor drums 101 that correspond to the colors of the input image data. For example, upon monochrome image forming, the electrostatic latent image and toner image for photoreceptor drum 101*a* corresponding to black color are formed, so that the black toner image alone is transferred to the outer peripheral surface of intermediate transfer belt 11.

Each of primary transfer rollers 13*a* to 13*d* is composed of a shaft formed of metal (e.g., stainless steel) having a diameter of 8 to 10 mm and a conductive elastic material (e.g., EPDM, foamed urethane, etc.,) coated on the shaft surface (resulting outside diameter of 12 to 16 mm), and uniformly applies a high voltage to intermediate transfer belt 11 through the conducive elastic material.

The toner image formed on the outer peripheral surface of intermediate transfer belt 11 by image transfer at primary transfer stations in photoreceptor drums 101*a* to 101*d* is conveyed as intermediate transfer belt 11 rotates to the secondary transfer station where the belt opposites secondary transfer roller 14.

During image forming, secondary transfer roller 14 is abutted with a predetermined nip pressure against the outer peripheral surface of intermediate transfer belt 11, in the area where the interior side of intermediate transfer belt 11 comes into contact with the peripheral surface of drive roller 11*a*. When paper 30 fed from paper feed cassette 16 or manual paper feed tray 17 passes through the nip between secondary transfer roller 14 and intermediate transfer belt 11, a high voltage of a polarity opposite to the polarity of the electrostatic charge on the toner is applied to secondary transfer roller 14. In this way, the toner image is transferred from the outer peripheral surface of intermediate transfer belt 11 to the paper.

The toner that has been transferred from photoreceptor drum 101 to intermediate transfer belt 11 and remains on intermediate transfer belt 11 without being transferred to paper 30 is collected by cleaning unit 12 in order to prevent color contamination at the next operation.

The paper 30 with the toner image transferred thereon is lead to fuser 15 and undergoes heating and pressing while passing through and between heat roller 15*a* and pressing roller 15*b*. Thereby, the toner image is firmly fixed to the paper surface. The paper with the toner image fixed thereon is discharged by a paper discharge roller 18*a* onto paper output tray 18.

Image forming apparatus 100 includes a paper feed path P1 that extends approximately vertically to convey the paper 30 stacked in paper feed cassette 16 to paper output tray 18 by way of the nip between secondary transfer roller 14 and intermediate transfer belt 11 and fuser 15.

Arranged along paper feed path P1 are a pickup roller 16*a* for delivering sheets of paper 30 from paper feed cassette 16, one by one, into paper feed path P1, conveying rollers r for conveying the delivered sheet of paper 30 upwards, a registration roller 19 for leading the conveyed paper to the nip between secondary transfer roller 14 and intermediate transfer belt 11 at a predetermined timing and paper discharge roller 18*a* for discharging paper 30 to paper output tray 18.

Image forming apparatus 100 also incorporates a paper feed path P2 that extends from manual paper feed tray 17 to registration roller 19, having a pickup roller 17*a* and conveying rollers r arranged therealong. There is also another paper feed path P3 that extends from paper discharge roller 18*a* toward the upstream side of registration roller 19 in paper feed path P1.

Paper discharge roller 18*a* is adapted to rotate in both forward and reverse directions, and is rotated in the forward direction to discharge paper 30 to paper output tray 18 at the time of one-sided image forming for forming an image on one side of the paper and at the time of the second side image forming in duplex image forming for forming images on both sides.

On the other hand, at the time of the first side image forming in duplex image forming, paper discharge roller 18*a* is driven in the forward direction until the rear end of paper 30 passes by fuser 15 and then rotated in reverse while it is holding the rear end of paper 30 to lead paper 30 into paper feed path P3. Thereby, the paper 30 with an image formed on only one side thereof during duplex image forming is lead to paper feed path P1 with its printed face down and its front edge inverted to the rear.

Registration roller 19 leads the paper 30 that has been fed from paper feed cassette 16 or manual paper feed tray 17 or that has been conveyed through paper feed path P3, to the nip between secondary transfer roller 14 and intermediate transfer belt 11 at a timing synchronized with the rotation of intermediate transfer belt 11.

For this purpose, registration roller 19 stops rotating when photoreceptor drums 101 and intermediate transfer belt 11 start operating while the paper 30 that was started to be fed or conveyed in advance of rotation of intermediate transfer belt 11 is stopped from moving in paper feed path P1 with its front end abutting against registration roller 19.

Thereafter, registration roller 19 starts rotating at such a timing that the front edge of the paper and the front end of the toner image formed on intermediate transfer belt 11 meet each other at the position where secondary transfer roller 14 and intermediate transfer belt 11 come in pressure contact with each other.

Here, when full-color image forming is performed with all the image forming portions Pa to Pd, primary transfer rollers 13*a* to 13*d* are adapted to abut intermediate transfer belt 11 against respective photoreceptor drums 101*a* to 101*d*. On the other hand, when monochrome image forming is performed with image forming portion Pa alone, the primary transfer roller 13*a* alone is adapted to abut intermediate transfer belt 11 against photoreceptor drum 101*a*.

Next, the configuration of transfer belt unit 110 which characterizes the present embodiment will be described in detail with reference to the drawings.

Figure 2:
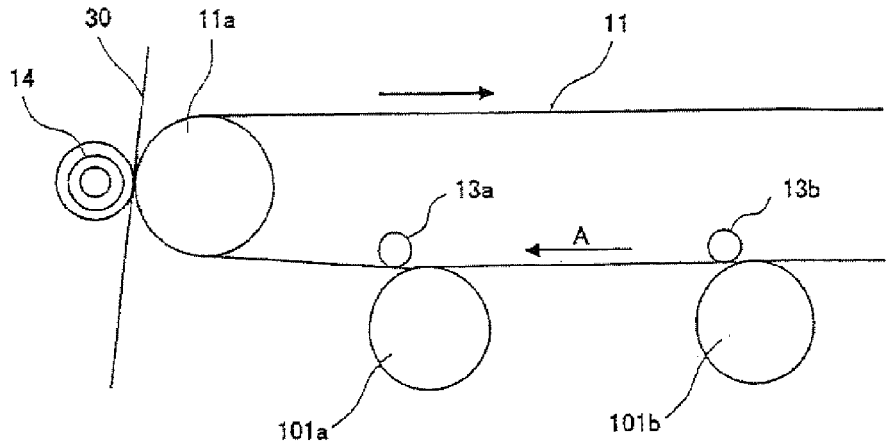
FIG. 2 is an illustrative view showing the configuration of a transfer belt unit constituting the image forming apparatus.
Figure 3:
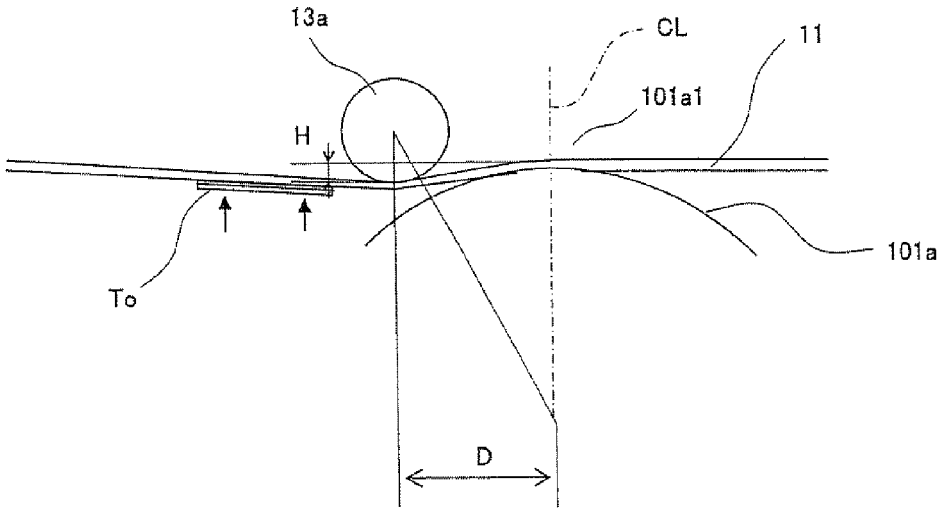
FIG. 3 is a partial detailed view showing the configuration of a primary transfer station formed of a transfer belt for the transfer belt unit, a transfer roller and a photoreceptor drum.

FIG. 2 is an illustrative view showing the configuration of a transfer belt unit according to the present embodiment; FIG. 3 is a partial detailed view showing the configuration of a primary transfer station comprised of a transfer belt for the transfer belt unit, a transfer roller and a photoreceptor drum; and FIG. 4 is a partial detailed view showing the configuration of a secondary transfer station near the drive roller of the transfer belt unit.

Intermediate transfer belt 11 is formed to be 50 μm thick, and is arranged so as to circulate in the direction of arrow A by means of drive roller 11*a* along photoreceptor drums 101*a* and 101*b* shown in FIG. 2 and photoreceptor drums 101*c* and 101*d* (FIG. 1) not shown in FIG. 2, all arranged side by side.

Secondary transfer roller 14 is laid out opposite to drive roller 11*a*.

Figure 4:
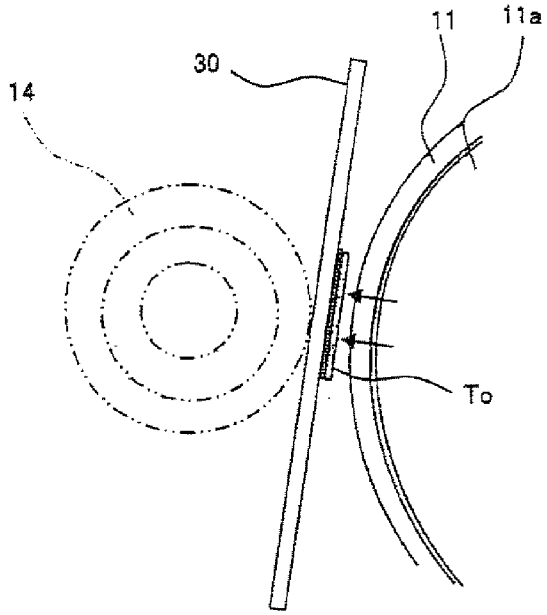
FIG. 4 is a partial detailed view showing the configuration of a secondary transfer station near the drive roller of the transfer belt unit.

As paper 30 is nipped between and conveyed by the secondary transfer roller 14 and intermediate transfer belt 11 circulated by drive roller 11*a*, secondary transfer is performed, specifically, the toner image on intermediate transfer belt 11 is transferred to paper 30 as shown in FIG. 4. A symbol TO in the drawing represents a toner image.

The photoreceptor drum 101*a* and photoreceptor drum 101*b* shown in FIG. 2 are for black and for cyan, respectively. Photoreceptor drums 101*a* and 101*b* are formed to be 30 mm in diameter. The primary transfer rollers 13*a* and 13*b* respectively corresponding to photoreceptor drums 101*a* and 101*b* are formed to be 14 mm in diameter.

In each of these photoreceptor drums 101*a*, 101*b*, 101*c* and 101*d*, primary transfer is performed. Specifically, the images of different colors formed on these photoreceptor drums are transferred to intermediate transfer belt 11 at their associated primary transfer stations.

Now, the positional relationship between photoreceptor drum 101 and primary transfer rollers 13 will be detailed by describing the positional relationship between photoreceptor drum 101*a* and primary transfer rollers 13*a* as an example.

At primary transfer station 101*a*1 where the toner image is transferred from photoreceptor drum 101*a* to intermediate transfer belt 11, photoreceptor drum 101*a* and primary transfer roller 13*a* are arranged at off-centered positions, as shown in FIG. 3.

Specifically, primary transfer roller 13*a* is arranged at a position, along the moving direction of intermediate transfer belt 11 (which may be written merely as "moving direction"), deviated by a spacing distance D (D=8.1 mm) downstream with respect to the moving direction from the position where intermediate transfer belt 11 is in contact with photoreceptor drum 101*a*.

That is, the rotational axis of primary transfer roller 13*a* is arranged at the position deviated on the downstream side in the direction perpendicular to the center line CL by the spacing distance D from the intersection between the center line CL and intermediate transfer belt 11 as shown in FIG. 3.

The center line CL is the line that joins between the rotational axis of photoreceptor drum 101*a* and the center position (point of contact) of the nip area between intermediate transfer belt 11 and photoreceptor drum 101*a* with respect to the moving direction. For example, the center line CL extends in the vertical direction and the spacing distance D is a distance in the horizontal direction.

Though in the present embodiment, the spacing distance D is specified to be 8.1 mm, but is not limited to this. Specifying the spacing distance D within the range from 5 mm to 10 mm can provide fair toner images.

Detailedly, when the displacement of primary transfer roller 13*a* from photoreceptor drum 101*a* is smaller than 5 mm, sufficient effect cannot be obtained from the off-centered arrangement. When the displacement is greater than 10 mm, transfer failure will occur because the transfer potential applied to primary transfer roller 13*a* cannot produce electric current through photoreceptor drum 101*a*.

In addition, the point of contact between primary transfer roller 13*a* and intermediate transfer belt 11 and the point of contact between photoreceptor drum 101*a* and intermediate transfer belt 11 are differentiated by a distance H with respect to the direction in which the center line CL extends is specified.

In other words, primary transfer roller 13*a* is set off in the direction parallel to the center line CL by an approach distance H (H=0.68 mm) closer (projected to the photoreceptor drum 101*a* side) to photoreceptor drum 101*a*, from the tangent line between intermediate transfer belt 11 and the outer peripheral surface of photoreceptor drum 101*a*. Under this condition, the belt is arranged so that the pressure of intermediate transfer belt 11 at the nip (the pressing force against the photoreceptor drum) is 34 gf/cm$^2$. Since the pressure at the nip when an intermediate transfer belt of 80 μm thick is used amounts to 79 gf/cm$^2$, the nip pressure can be reduced to half or lower. The direction of approach distance H is perpendicular to the direction of spacing distance D; the direction of approach distance H is, for example, vertical.

When approach distance H is less than 0.5 mm, the nip pressure is as low as 10 gf/cm$^2$ so that the variation in pressure at the nip becomes large, hence there is a fear of local primary transfer failure occurring. Conversely, when approach distance H exceeds 0.9 mm, the nip pressure becomes excessively high or as high as 50 gf/cm$^2$, so that there is a fear that rotary torque increases and/or intermediate transfer belt 11 is broken.

In the present embodiment, approach distance H may be specified to range from 0.5 mm to 0.8 mm and the nip pressure of intermediate transfer belt 11 against the photoreceptor drum may be specified to range from $9.8\times10^{-2}$ MPa (10 gf/cm$^2$) to $39.2\times10^{-2}$ MPa (40 gf/cm$^2$).

Further, in the present embodiment, approach distance H of primary transfer roller 13*b* to the adjacent photoreceptor drum 101*b* is specified to be 0.70 mm. In this way, the approach distance H is made smaller as the primary transfer roller 13 is located more downstream so as to weaken the pressing force as it goes downstream with respect to the moving direction of the intermediate transfer belt, whereby toner cohesion due to overlaying of toner images will be unlikely to occur at the primary transfer stations for the photoreceptor drums on the downstream side with respect to the moving direction of intermediate transfer belt.

Though the conventional intermediate transfer belt was about 70 μm to 100 μm thick, the thickness of intermediate transfer belt 11 is specified to be 50 μm in the present embodiment.

The reason for this specification is that if the intermediate transfer belt is thicker its rigidity is too strong so that the intermediate transfer belt cannot come into flexible contact with photoreceptor drum 101 and primary transfer roller 13 under the specified weak pressure of primary transfer roller 13, whereby transfer failure and toner cohesion are prone to occur. On the other hand, in order to avoid insufficient strength based on the stress calculation from the curvature of drive roller 11*a*, intermediate transfer belt 11 needs to be 30 μm or greater in thickness.

As to the physical properties of intermediate transfer belt 11, the transfer belt can be used if it is specified to have a tensile modulus of elasticity slightly higher, as high as 4000 MPa or greater and a typical surface resistivity of $10^8\Omega/\square$ to $10^{12}\Omega/\square$ and a volume resistivity of $10^7\Omega\cdot$cm to $10^{11}\Omega\cdot$cm.

The material of intermediate transfer belt 11 employs polyimide-based resin.

The reason for using polyimide-based resin is that intermediate transfer belt 11 made of polycarbonate resin is prone to crack. Use of a rubber material having low elasticity may produce the same effect at the initial stage, but it is not preferred since elastic elongation occurs as the belt is used (during its life) and hence causes color misregistration.

In order to determine the durability of intermediate transfer belt 11 of polyimide-based resin, the following accelerated test was carried out. That is, time until intermediate transfer belt 11 cracked was measured by changing the diameter of drive roller 11*a* that circulatively drives intermediate transfer belt 11.

As the measurement conditions, the intermediate transfer belt wound on drive roller 11*a* and driven roller 11*b* of the same diameter was driven at a circulating speed of 300 mm/sec with a torque of 0.196 N·m and a tension of 19.61 N. The result is shown in Table 1.

TABLE 1

| Diameter (mm) | Time until the belt cracked (H) |
|---|---|
| 10 | 17 |
| 12 | 250 |
| 15 | 280 |
| 20 | 325 |

From Table 1, when the diameter of drive roller 11*a* and drive roller 11*b* was 10 mm, 12 mm, 15 mm and 20 mm, time (H) until the belt cracked was 17 hours, 250 hours, 280 hours and 325 hours, respectively.

That is, it is understood that the durability of intermediate transfer belt 11 when the roller diameter is 12 mm is about 15 times longer than that when the roller diameter is 10 mm. On the other hand, the durabilities of intermediate transfer belt 11 when the roller diameter is 15 mm and 20 mm are merely about 1.1 times and about 1.3 times longer than that when the roller diameter is 12 mm.

From the above result, when the diameter of drive roller 11*a* and driven roller 11*b* is equal to or greater than 12 mm, the durability of intermediate transfer belt 11 is markedly enhanced so that it is possible to obtain a device which is practically free from the cracking problem with intermediate transfer belt 11 and other problems.

Next, the toner used in image forming apparatus 100 according to the present embodiment will be described with reference to the drawings.

Figure 5:
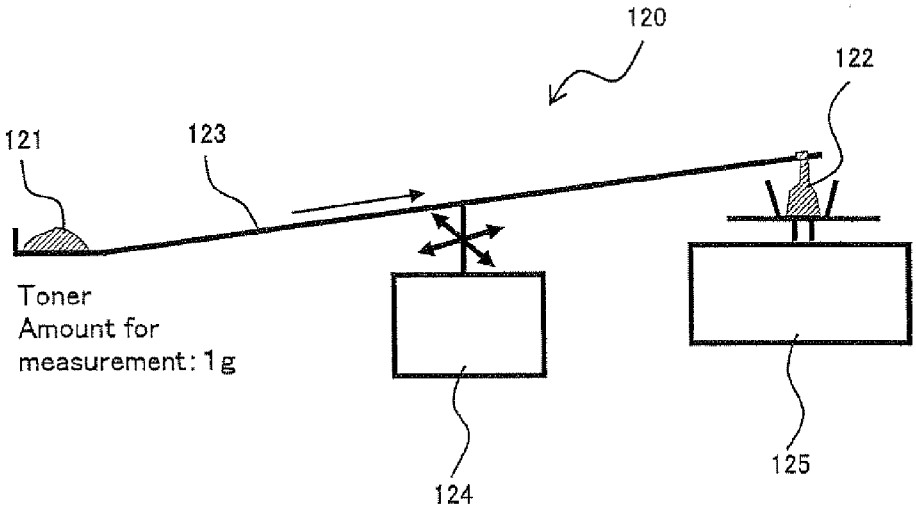
FIG. 5 is an illustrative view showing the measurement principle for measuring the fluidity of the toner used in the image forming apparatus.

FIG. 5 is an illustrative view showing the measurement principle for measuring the fluidity of the toner used in the image forming apparatus of the present embodiment.

In the present embodiment, bad fluidity toner having a fluidity of 2 mg/sec or greater measured based on a vibration technique is used.

As the specific evaluation method of fluidity, a simple method as follows can be used.

Specifically, measurement of toner fluidity can be carried out using a simple measuring device 120 mainly comprised of, as shown in FIG. 5, a measuring table 123 holding toner 121 at the first end side and having a weight 122 arranged on the second end side as a standard for weight, a vibrator 124 for providing a vibratory motion to measuring table 123 and an electrobalance 125 for measuring the weight of toner.

Measuring device 120 is constructed so that measuring table 123 made of SUS316 and having a surface roughness Ra of 0.2 μm is inclined about 20 degrees, a small amount (1 g) of toner 121 is put on the first end side that is located on the lower side of the slope and weight 122 is disposed on the second end side that is located on the upper side. Electroblance 125 for weighing weight 122 is arranged at the bottom of weight 122 while vibrator 124 for producing vibratory motion is set at the approximate center of the length of measuring table 123.

The measurement of the fluidity of toner 121 can be represented by the amount of toner 121 moving from the first end side of measuring table 123 upward (toward the second end side) per unit time (mg/sec) when vibratory motion of 140 Hz is added to measuring table 123 by vibrator 124.

The present invention is more effective when a toner that is easy to cohere having a fluidity of 2 mg/sec or greater is used as the toner used for image forming apparatus 100.

That is, though transfer belt unit 110 is basically designed to produce a nip pressure which is so low as not to cause the toner to cohere, it is understood that the transfer belt unit 110 of the present invention is effective to the cohesive toners when the ratio of increase in transfer efficiency [(transferred solid area unevenness 2-transferred solid area unevenness 1)/transferred solid area unevenness 1] is used as the basis for evaluation. Evaluation of the test was made using the after-mentioned IGEPA paper and magenta toner, based on the degree of change when the thickness of intermediate transfer medium 11 was changed from 80 μm to 50 μm. The detail of the evaluation method will be described later.

The reason for this result is that the cohesive (bad fluidity) toner is considered as that its particles cohere to each other in such a level that they can be easily separated by transfer electric field though van der Waals forces (intermolecular forces) between toner particles are apparently strong.

TABLE 2

| Toner fluidity ($g/cm^2$) | Transferred solid area unevenness 1 (80 μm) | Transferred solid area unevenness 2 (50 μm) | Increase ratio | Effect |
|---|---|---|---|---|
| 1.5 | 0.60 | 0.48 | 0.20 | Weak |
| 2.0 | 0.90 | 0.52 | 0.42 | Strong |
| 2.5 | 0.99 | 0.55 | 0.44 | Strong |
| 3.0 | 1.10 | 0.60 | 0.45 | Strong |

Also, in the present embodiment, the volume mean particle size of the toner is specified to be 6.5 μm.

If the volume mean particle size is smaller than the lower limit, i.e., 4 μm, the toner cannot secure the necessary development performances such as fluidity, mixing and agitating performance and the like, hence the transfer performance degrades. The effect of the present invention becomes more distinct when the volume mean size of the toner becomes smaller because the toner becomes more cohesive.

In sum, the toner on intermediate transfer belt 11 adheres thereto by mechanical adhesive force and electric adhesive force. Since the toner becomes more unlikely to retain charge when the mean particle size of the toner is smaller, the electric adhesive force becomes smaller while the mechanical adhesive force becomes greater. Accordingly, since transfer belt unit 110 of the present invention is designed to lower the mechanical adhesive force so as to balance the adhesive force, it is possible to improve transfer performance.

Next, the transfer behavior of toner images depending on the thickness of intermediate transfer belt 11 in image forming apparatus 100 will be described based on data.

Figure 6A:
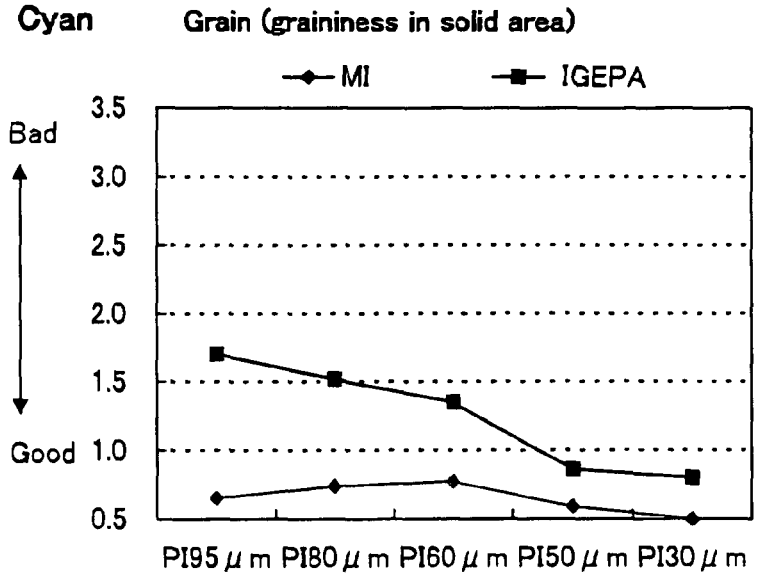
FIG. 6A is a graph showing the transfer behavior (graininess in solid area) of singular cyan toner layer depending on the thickness of the intermediate transfer belt.
Figure 6B:
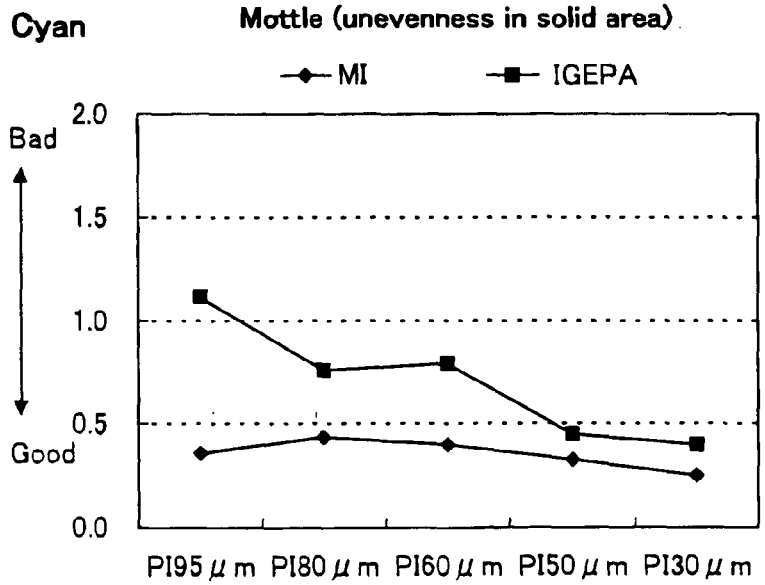
FIG. 6B is a graph showing the transfer behavior (unevenness in solid area) of singular cyan toner layer depending on the thickness of the intermediate transfer belt.
Figure 7A:
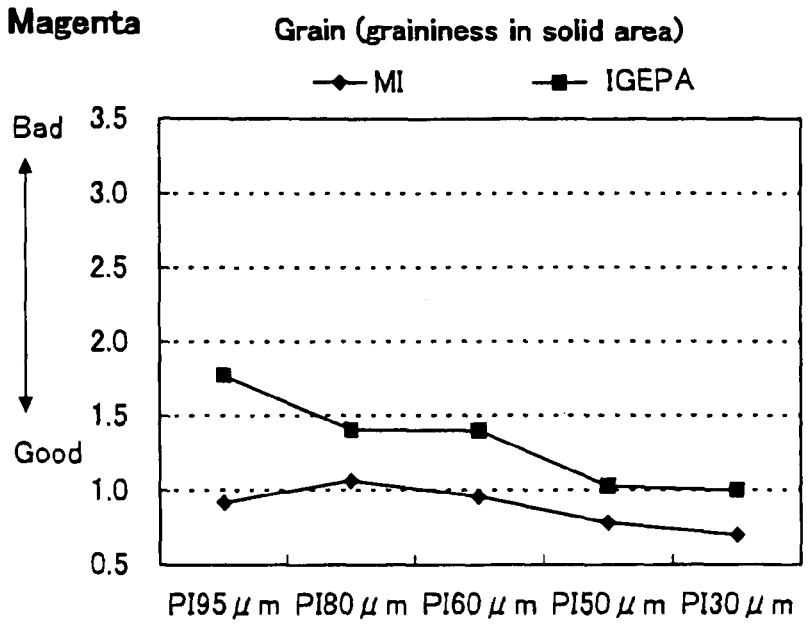
FIG. 7A is a graph showing the transfer behavior (graininess in solid area) of singular magenta toner layer depending on the thickness of the intermediate transfer belt.
Figure 7B:
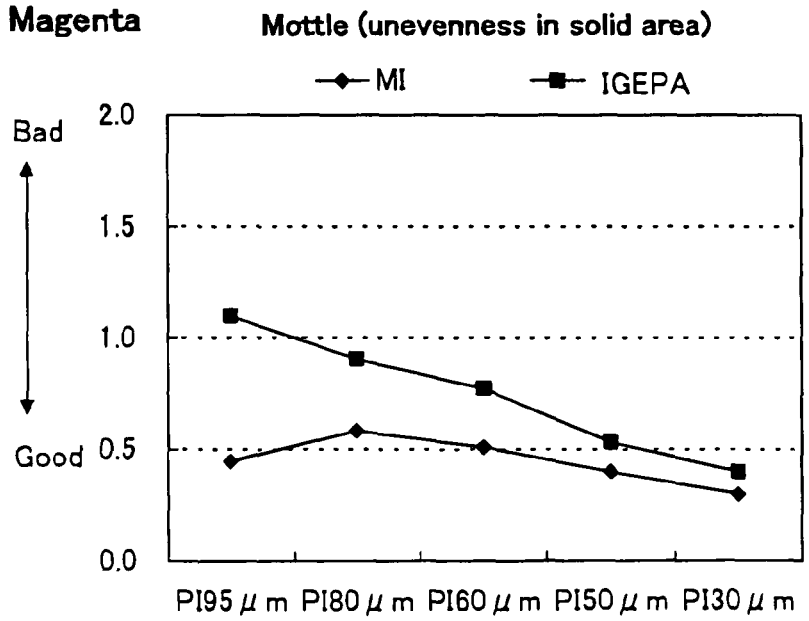
FIG. 7B is a graph showing the transfer behavior (unevenness in solid area) of singular magenta toner layer depending on the thickness of the intermediate transfer belt.
Figure 8A:
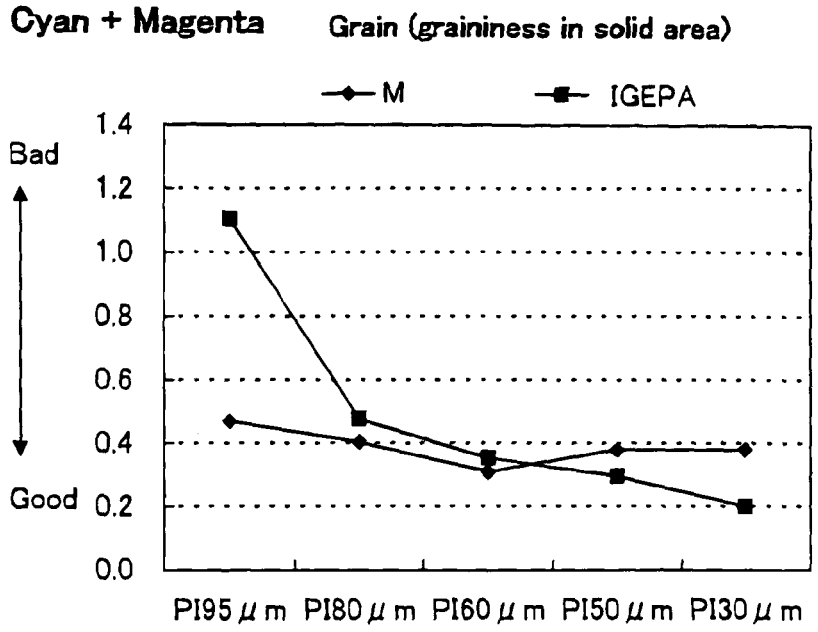
FIG. 8A is a graph showing the transfer behavior (graininess in solid area) of multi-layered toner of cyan and magenta toners depending on the thickness of the intermediate transfer belt.
Figure 8B:
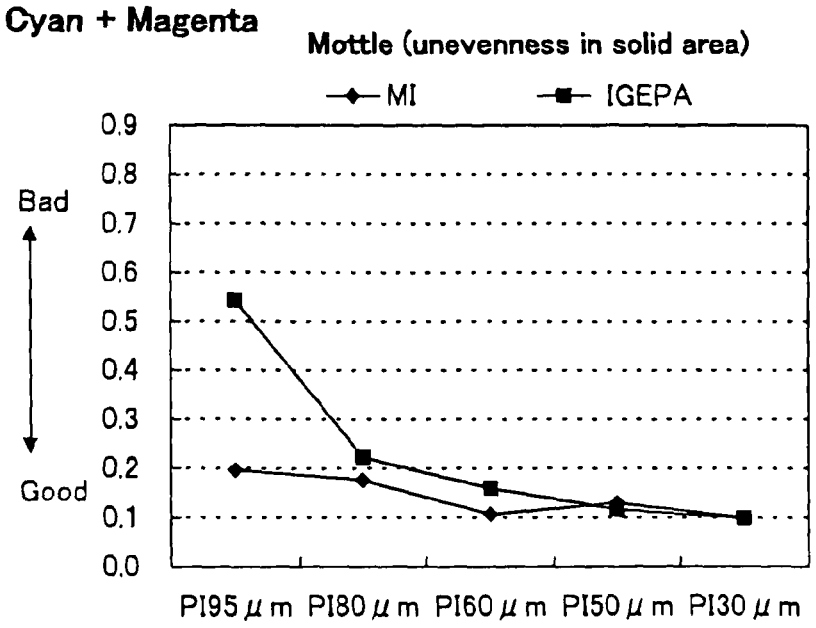
FIG. 8B is a graph showing the transfer behavior (unevenness in solid area) of multi-layered toner of cyan and magenta toners depending on the thickness of the intermediate transfer belt; and, FIG. 9 is a table showing the character void ratio depending on the thickness of the intermediate transfer belt.

FIG. 6A is a graph showing the transfer behavior (graininess in solid area) of singular cyan toner layer depending on the thickness of the intermediate transfer belt; FIG. 6B is a graph showing the transfer behavior (unevenness in solid area) of singular cyan toner layer depending on the thickness of the intermediate transfer belt; FIG. 7A is a graph showing the transfer behavior (graininess in solid area) of singular magenta toner layer depending on the thickness of the intermediate transfer belt; FIG. 7B is a graph showing the transfer behavior (unevenness in solid area) of singular magenta toner layer depending on the thickness of the intermediate transfer belt; FIG. 8A is a graph showing the transfer behavior (graininess in solid area) of multi-layered toner of cyan and magenta toners depending on the thickness of the intermediate transfer belt; and, FIG. 8B is a graph showing the transfer behavior (unevenness in solid area) of multi-layered toner of cyan and magenta toners depending on the thickness of the intermediate transfer belt.

Here, graininess in solid area represents the degree of being grainy in the area image or the irregularity (micro noise) in density that occurs in high spatial frequency, not including irregularity of the spatial scale of 250 μm or greater.

On the other hand, unevenness in solid area represents mottle (the degree of lacking in uniformity) in the area image or the irregularity (rough noise) in density that occurs in low spatial frequency, not including irregularity of the spatial scale of 250 μm or smaller. As the specific measuring method, the captured data of the area image to be evaluated is analyzed so as to evaluate it in a relative manner with a numerical value ranging from 0 (when the image is even) to 5.0 (when the data is maximally uneven).

To determine the transfer behavior depending on the thickness of intermediate transfer belt 11 in image forming apparatus 100, toner images formed of singular toner layer and multi-layered toner on different kinds of paper were evaluated as to graininess in solid area (irregularity in density that occurs in high spatial frequency: Grain) and unevenness in solid area (irregularity in density that occurs in low spatial frequency: Mottle). As the paper for evaluation, two kinds of paper, namely, MI paper (recommended by Sharp Corporation), Japan-made medium-grade printing paper of about 60 μm thick with a surface roughness Ra of 1.0 μm, and IGEPA paper, US-made medium-grade printing paper of about 90 μm thick with a surface roughness Ra of 2.1 μm, were used.

When the toner image is of a single layer, the transfer performance regarding both "graininess in solid area" and "unevenness in solid area" becomes better as intermediate transfer belt 11 becomes thinner, as shown in FIGS. 6A, 6B, 7A and 7B. In particular, it is found that the better result can be obtained for thicker paper, i.e., the IGEPA paper. Further, it is understood that when intermediate transfer belt 11 is about 30 μm to 50 μm thick, good transfer behavior is obtained for both the MI paper and the IGEPA paper.

When the toner image is of multiple layers, similarly to the case where the toner image is of a single layer the transfer performance regarding both "graininess in solid area" and "unevenness in solid area" becomes better as intermediate transfer belt 11 becomes thinner, as shown in FIGS. 8A and 8B. In particular, it is found that the better result can be obtained for thicker paper, i.e., the IGEPA paper, and the effect is more distinctive when the thickness is 30 μm to 80 μm, even compared to the case of the toner image of a single layer.

Next, "the character void ratio" in the transfer result depending on the thickness of intermediate transfer belt 11 in image forming apparatus 100 will be described based on data.

FIG. 9 is a table showing the character void ratio depending on the thickness of the intermediate transfer belt in the present embodiment.

Evaluation of the character void ratio is made by forming a plurality of 10×10 dot patterns over the whole surface of A4-sized paper and counting the number of dots with voids, so as to obtain the ratio of the number of dots with voids to the total number of dots.

It is understood that as to the transfer behavior depending on the thickness of intermediate transfer belt 11 in image forming apparatus 100, the character void ratio greatly varies depending on the paper types as shown in FIG. 9. However, when the thickness of intermediate transfer belt 11 is 50 μm, the character void ratio lowers to such a level as not to cause problems with the MI paper and the IGEPA paper.

As described heretofore, according to the present invention, in image forming apparatus 100, intermediate transfer belt 11 is formed to be 50 μm in average thickness while primary transfer roller 13 is arranged at a position, along the moving direction of intermediate transfer belt 11, which is deviated by 8.1 mm downstream with respect to the moving direction from the position where intermediate transfer belt 11 is in contact with photoreceptor drum 101 and which is projected downward to the photoreceptor drum 101 side by 0.68 mm, from the tangent line between intermediate transfer belt 11 and the outer peripheral surface of photoreceptor drum 101, so as to press intermediate transfer belt 11 against photoreceptor drum 101 with a nip pressure of 34 g/cm$^2$. As a result, it is possible to suppress the toner from cohering when the toner image is transferred to belt-like intermediate transfer medium 11 at the primary transfer. Accordingly, it is possible to realize a transfer belt unit and an image forming apparatus using this, which are excellent in secondary transfer performance without the need of complicated control.

Further, according to the present embodiment, use of polyimide-based resin for intermediate transfer belt 11 enhances the belt in tensile modulus of elasticity and hence makes it unlikely to stretch, improving the mechanical durability of intermediate transfer belt 11. Accordingly, it is possible to lengthen the life of transfer belt unit 110.

According to the present embodiment, since the diameter of drive roller 11*a* for supporting and conveying intermediate transfer belt 11 is specified to be 12 mm or greater, it is possible to secure a large curvature at the bend of intermediate transfer belt 11, hence improve the durability of the intermediate transfer belt.

Furthermore, according to the present embodiment, even when a cohesive toner having a toner fluidity of 2 mg/sec or greater is used as the toner for image forming apparatus 100, it is possible to suppress toner cohesion at the primary transfer and hence perform fair secondary transfer.

Moreover, according to the present embodiment, even when a toner having a volume mean particle size of 4 μm to 7 μm is used as the toner for image forming apparatus 100, it is possible to suppress toner aggregation at the primary transfer and hence perform fair secondary transfer.

According to the present embodiment, as to the nip pressures (pressing forces) of primary transfer rollers 13*a*, 13*b*, 13*c* and 13*d* used in image forming apparatus 100 against intermediate transfer belt 11, it was confirmed from experiment that the transfer performance can be improved when the nip pressures against intermediate transfer belt 11 are specified to be smaller toward the downstream side with respect to the moving direction of intermediate transfer belt 11. Specifically, the transfer performance (unevenness in solid area) was examined using the aforementioned cyan toner and MI paper by minutely varying the position of each transfer roller. The result is shown in Table 3.

TABLE 3

| Transfer roller | 13a | 13b | 13c | 13d | Transfer performance (unevenness in solid area) |
|---|---|---|---|---|---|
| Pressure (g/cm$^2$) | 3.0 | 3.0 | 3.0 | 3.0 | 4.5 |
| | 2.8 | 3.0 | 3.2 | 3.4 | 4.0 |
| | 3.4 | 3.2 | 3.0 | 2.8 | 6.1 |

Here, the present embodiment has been described as to an electrophotographic image forming apparatus capable of color image forming and a transfer belt unit used therefor, but the present invention should not be limited to the image forming apparatus having the above configuration, and can be applied to other types of image forming apparatus etc. For example, the present invention is applicable to an electrophotographic image forming apparatus capable of monochrome image forming only.

As has been described, the present invention is not limited to the above embodiment, and various modifications can be made within the range specified in the scope of claims. That is, any embodied mode obtained by combination of technical means modified as appropriate without departing from the spirit and scope of the present invention should be included in the technical art of the present invention.

What is claimed is:

1. A transfer belt unit comprising:

a belt-like intermediate transfer medium for temporarily supporting a toner image that was formed on the surface of a photoreceptor; and a transfer roller for pressing the intermediate transfer medium against the photoreceptor, characterized in that the intermediate transfer medium has the toner image transferred from the photoreceptor surface whilst moving along the surface of the photoreceptor, the intermediate transfer medium is formed to be no less than 30 μm and no more than 50 μm in average thickness, and, the transfer roller is arranged, along the moving direction of the intermediate transfer medium downstream with respect to the moving direction from the point where the intermediate transfer medium is in contact with the photoreceptor and which is arranged closer to the photoreceptor side, from the position on the tangent line passing the contact point where the intermediate transfer medium comes into contact first in the moving direction with the outer peripheral surface of the photoreceptor, so as to press the intermediate transfer medium against photoreceptor with a nip pressure ranging from no less than $9.8\times10^{-2}$ MPa and no more than $39.2\times10^{-2}$ MPa.

2. The transfer belt unit according to claim 1, wherein the intermediate transfer medium is configured so as to be able to have toner images formed by a plurality of photoreceptors that are arranged in turn in the moving direction of the intermediate transfer medium, a plurality of transfer rollers are arranged at positions corresponding to the plural photoreceptors, and the plural transfer rollers are arranged so that the transfer roller corresponding to the photoreceptor located on the more downstream side with respect to the moving direction of the intermediate transfer medium is arranged less close to the photoreceptor side from the position on the tangent line passing the contact point where the intermediate transfer medium comes into contact first in the moving direction with the outer peripheral surface of the photoreceptor.

3. The transfer belt unit according to claim 1, wherein the distance of the transfer roller approaching toward the photoreceptor is no less than 0.5 mm and no more than 0.8 mm.

4. The transfer belt unit according to claim 1, wherein the intermediate transfer medium is formed of polyimide-based resin.

5. The transfer belt unit according to claim 1, wherein the transfer belt unit includes a drive roller that supports and drives the intermediate transfer medium, and the drive roller is 12 mm or greater in diameter.

6. An image forming apparatus using the transfer belt unit according to claim 1.

7. The image forming apparatus according to claim 6, wherein the toner for forming the toner image is specified so that the fluidity measured by a vibration technique is equal to or greater than 2 mg/sec.

8. The image forming apparatus according to claim 6, wherein the toner for forming the toner image is specified so that the volume mean particle diameter of the toner is no less than 4 μm and no more than 7 μm.

9. The image forming apparatus according to claim 6, wherein the nip pressure of the intermediate transfer belt on the transfer roller is made smaller as it goes toward the downstream side with respect to the circulating direction of the intermediate transfer belt.

* * * * *